US005794313A

United States Patent [19]

Parsons

[11] Patent Number: 5,794,313

[45] Date of Patent: Aug. 18, 1998

[54] SAFETY BAR SECUREMENT STRAP FOR POWER EQUIPMENT

[76] Inventor: Daniel P. Parsons, 7300 Pursley Dr. Apt. D, New Port Richey, Fla. 34653

[21] Appl. No.: 988,629

[22] Filed: Dec. 11, 1997

[51] Int. Cl.[6] ..... A44B 18/00

[52] U.S. Cl. ..... 24/306; 24/3.13

[58] Field of Search ..... 24/306, 442, 265 R, 24/265 EL, 301, 302, 3.13

[56] References Cited

U.S. PATENT DOCUMENTS

| | | | |
|---|---|---|---|
| 3,501,774 | 3/1970 | Norman | 24/306 X |
| 3,638,284 | 2/1972 | Baker | 24/306 |
| 3,841,648 | 10/1974 | Meyer | 24/306 X |
| 4,858,249 | 8/1989 | Stewart | 24/306 X |
| 4,862,563 | 9/1989 | Flynn | 24/306 X |
| 5,174,483 | 12/1992 | Moore, IV et al. | 24/306 X |
| 5,214,874 | 6/1993 | Faulkner | 24/306 X |
| 5,638,581 | 6/1997 | Burke | 24/306 X |

*Primary Examiner*—Randolph A. Reese
*Assistant Examiner*—Robert J. Sandy

[57] ABSTRACT

A new safety bar securement strap for power equipment for maintaining a motor of the power equipment in an operative orientation. The inventive device includes a handle strap having a generally rectangular configuration. The handle strap has an upper surface and a lower surface. The upper surface has a pair of male snaps thereon inwardly of an outer edge thereof. The upper surface has a pair of female snaps thereon disposed inwardly from the outer edge thereof. The handle strap wraps around a handle of a piece of power equipment with the male snaps coupling with the female snaps for securement to the handle. The upper surface has a hook and loop patch disposed thereon inwardly of the female snaps. A safety bar strap is provided having a generally rectangular configuration. An inner edge of the safety bar strap is secured to an inner edge of the handle strap. A lower surface of the safety bar strap has a plurality of hook and loop strips disposed thereon in a spaced relationship. The safety bar strap wraps around a safety bar of the piece of power equipment with one of the plurality of hook and loop strips mating with the hook and loop patch of the handle strap to engage the safety bar with the handle.

1 Claim, 1 Drawing Sheet

SAFETY BAR SECUREMENT STRAP FOR POWER EQUIPMENT

BACKGROUND OF THE INVENTION

1. Field of the Invention

The present invention relates to tool accessories and more particularly pertains to a new safety bar securement strap for power equipment for maintaining a motor of the power equipment in an operative orientation.

2. Description of the Prior Art

The use of tool accessories is known in the prior art. More specifically, tool accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool accessories include U.S. Pat. No 5,082,156 to Braun; U.S. Pat. No. 5,130,899 to Larkin et al.; U.S. Pat. No. 5,131,151 to Agase et al.; U.S. Pat. No. 4,047,651 to McMullen; U.S. Pat. No. 3,977,638 to Woodard; and U.S. Pat. No. Des. 308,465 to Hietter.

While these devices fulfill their respective, particular objectives and requirements, the aforementioned patents do not disclose a new safety bar securement strap for power equipment. The inventive device includes a handle strap having a generally rectangular configuration. The handle strap has an upper surface and a lower surface. The upper surface has a pair of male snaps thereon inwardly of an outer edge thereof. The upper surface has a pair of female snaps thereon disposed inwardly from the outer edge thereof. The handle strap wraps around a handle of a piece of power equipment with the male snaps coupling with the female snaps for securement to the handle. The upper surface has a hook and loop patch disposed thereon inwardly of the female snaps. A safety bar strap is provided having a generally rectangular configuration. An inner edge of the safety bar strap is secured to an inner edge of the handle strap. A lower surface of the safety bar strap has a plurality of hook and loop strips disposed thereon in a spaced relationship. The safety bar strap wraps around a safety bar of the piece of power equipment with one of the plurality of hook and loop strips mating with the hook and loop patch of the handle strap to engage the safety bar with the handle.

In these respects, the safety bar securement strap for power equipment according to the present invention substantially departs from the conventional concepts and designs of the prior art, and in so doing provides an apparatus primarily developed for the purpose of maintaining a motor of the power equipment in an operative orientation.

SUMMARY OF THE INVENTION

In view of the foregoing disadvantages inherent in the known types of tool accessories now present in the prior art, the present invention provides a new safety bar securement strap for power equipment construction wherein the same can be utilized for maintaining a motor of the power equipment in an operative orientation.

The general purpose of the present invention, which will be described subsequently in greater detail, is to provide a new safety bar securement strap for power equipment apparatus and method which has many of the advantages of the tool accessories mentioned heretofore and many novel features that result in a new safety bar securement strap for power equipment which is not anticipated, rendered obvious, suggested, or even implied by any of the prior art tool accessories, either alone or in any combination thereof.

To attain this, the present invention generally comprises a handle strap having a generally rectangular configuration. The handle strap has an upper surface and a lower surface. The upper surface has a pair of male snaps thereon inwardly of an outer edge thereof. The upper surface has a pair of female snaps thereon disposed inwardly from the outer edge thereof. The handle strap wraps around a handle of a piece of power equipment with the male snaps coupling with the female snaps for securement to the handle. The upper surface has a hook and loop patch disposed thereon inwardly of the female snaps. A safety bar strap is provided having a generally rectangular configuration. An inner edge of the safety bar strap is secured to an inner edge of the handle strap. A lower surface of the safety bar strap has a plurality of hook and loop strips disposed thereon in a spaced relationship. The safety bar strap wraps around a safety bar of the piece of power equipment with one of the plurality of hook and loop strips mating with the hook and loop patch of the handle strap to engage the safety bar with the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new safety bar securement strap for power equipment apparatus and method which has many of the advantages of the tool accessories mentioned heretofore and many novel features that result in a new safety bar securement strap for power equipment which is not anticipated, rendered obvious, suggested, or even implied by any of the prior art tool accessories, either alone or in any combination thereof.

It is another object of the present invention to provide a new safety bar securement strap for power equipment which may be easily and efficiently manufactured and marketed.

It is a further object of the present invention to provide a new safety bar securement strap for power equipment which is of a durable and reliable construction.

An even further object of the present invention is to provide a new safety bar securement strap for power equipment which is susceptible of a low cost of manufacture with regard to both materials and labor, and which accordingly is then susceptible of low prices of sale to the consuming public, thereby making such safety bar securement strap for power equipment economically available to the buying public.

Still yet another object of the present invention is to provide a new safety bar securement strap for power equipment which provides in the apparatuses and methods of the prior art some of the advantages thereof, while simultaneously overcoming some of the disadvantages normally associated therewith.

Still another object of the present invention is to provide a new safety bar securement strap for power equipment for maintaining a motor of the power equipment in an operative orientation.

Yet another object of the present invention is to provide a new safety bar securement strap for power equipment which includes a handle strap having a generally rectangular configuration. The handle strap has an upper surface and a lower surface. The upper surface has a pair of male snaps thereon inwardly of an outer edge thereof. The upper surface has a pair of female snaps thereon disposed inwardly from the outer edge thereof. The handle strap wraps around a handle of a piece of power equipment with the male snaps coupling with the female snaps for securement to the handle. The upper surface has a hook and loop patch disposed thereon inwardly of the female snaps. A safety bar strap is provided having a generally rectangular configuration. An inner edge of the safety bar strap is secured to an inner edge of the handle strap. A lower surface of the safety bar strap has a plurality of hook and loop strips disposed thereon in a spaced relationship. The safety bar strap wraps around a safety bar of the piece of power equipment with one of the plurality of hook and loop strips mating with the hook and loop patch of the handle strap to engage the safety bar with the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
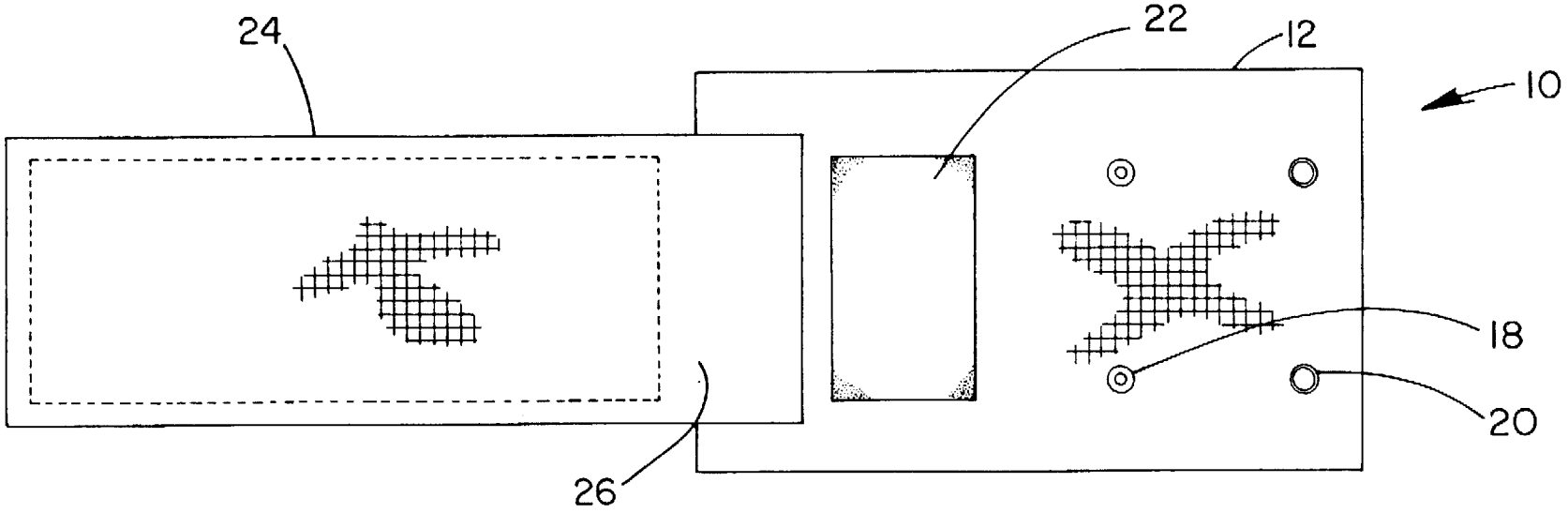
FIG. 1 is a plan view of a new safety bar securement strap for power equipment according to the present invention.
Figure 2:
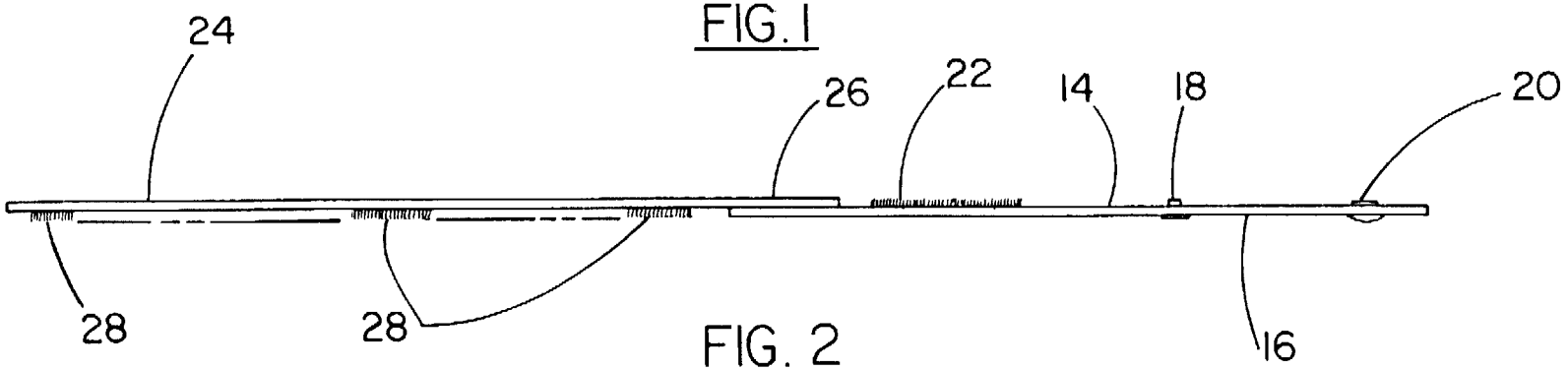
FIG. 2 is a side elevation view of the present invention.

With reference now to the drawings, and in particular to FIGS. 1 and 2 thereof, a new safety bar securement strap for power equipment embodying the principles and concepts of the present invention and generally designated by the reference numeral 10 will be described.

As best illustrated in FIGS. 1 and 2, the safety bar securement strap for power equipment 10 comprises a handle strap 12 having a generally rectangular configuration. The handle strap 12 has an upper surface 14 and a lower surface 16. The upper surface 14 has a pair of male snaps 18 thereon inwardly of an outer edge thereof. The upper surface 14 has a pair of female snaps 20 thereon disposed inwardly from the outer edge thereof. The handle strap 12 wraps around a handle of a piece of power equipment with the male snaps 18 coupling with the female snaps 20 for securement to the handle. The upper surface 14 has a hook and loop patch 22 disposed thereon inwardly of the female snaps 20.

A safety bar strap 24 is provided having a generally rectangular configuration. An inner edge 26 of the safety bar strap 24 is secured to an inner edge of the handle strap 12. A lower surface of the safety bar strap 24 has a plurality of hook and loop strips 28 disposed thereon in a spaced relationship. The safety bar strap 24 wraps around a safety bar of the piece of power equipment with one of the plurality of hook and loop strips 28 mating with the hook and loop patch 22 of the handle strap 12 to engage the safety bar with the handle.

In use, the present invention would be used to secure the safety bar of a walk-behind push lawn mower or other equipment to the handle of the equipment. The present invention would, thus keep the mower motor in the "on" position, while the operator tends to other activities in the yard. However, the design of the present invention would allow it to be quickly and easily removed in the event the motor needs to be quickly disabled. The present invention would wrap around the safety bar and handle and would be secured in a sufficiently tight position so as to stabilize the safety bar against the handle. However, a section of the safety bar strap 24 would hang from the safety bar so that it could be quickly accessed in the event the motor needed to be deactivated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new safety bar securement strap for power equipment for maintaining a motor of the power equipment in an operative orientation comprising, in combination:

a handle strap having a generally rectangular configuration, the handle strap having an upper surface and a lower surface, the upper surface having a pair of male snaps thereon inwardly of an outer edge thereof, the upper surface having a pair of female snaps thereon disposed inwardly from said outer edge, the handle strap for wrapping around a handle of a piece of power equipment with the male snaps coupling with the female snaps for securement to the handle, the upper surface having a hook and loop patch disposed thereon inwardly of the female snaps; and a safety bar strap having a generally rectangular configuration, an inner edge of the safety bar strap secured to an inner edge of the handle strap, a lower surface of the safety bar strap having a plurality of hook and loop strips disposed thereon in a spaced relationship, the safety bar strap for wrapping around a safety bar of the piece of power equipment with one of the plurality of hook and loop strips mating with the hook and loop patch of the handle strap to engage the safety bar with the handle.

* * * * *